United States Patent [19]

Leibowitz

[11] Patent Number: 4,486,951

[45] Date of Patent: Dec. 11, 1984

[54] IMPROVEMENT IN BLADE SYSTEMS FOR SHAVING APPARATUS

[76] Inventor: Martin N. Leibowitz, 1155 Hillsboro Mile, Suite 602, Hillsboro Beach, Fla. 33062

[21] Appl. No.: 414,615

[22] Filed: Sep. 3, 1982

[51] Int. Cl.[3] ..... B26B 21/38

[52] U.S. Cl. ..... 30/45; 30/40.1; 30/42

[58] Field of Search ..... 30/43.91, 45, 42, 43, 30/43.5, 40.1, 43.4

[56] References Cited

U.S. PATENT DOCUMENTS

| | | | |
|---|---|---|---|
| 1,199,706 | 9/1916 | McNichol . | |
| 1,208,491 | 12/1916 | Conill | 30/45 |
| 1,298,802 | 4/1919 | Sharpnack | 30/43.91 |
| 1,525,556 | 2/1925 | Kenney | 30/45 |
| 1,552,455 | 9/1925 | Shaler . | |
| 2,145,920 | 2/1939 | Davis | 30/40 |
| 2,210,110 | 8/1940 | Andis, Jr. | 30/43 |
| 2,232,271 | 2/1941 | Rider | 30/45 |
| 2,301,147 | 11/1942 | Schaaf | 30/45 |
| 2,326,192 | 8/1943 | Andis et al. | 30/43 |
| 2,485,056 | 10/1949 | Mathie | 30/43 |
| 2,975,516 | 3/1961 | Heyek | 30/34 |
| 3,001,281 | 9/1961 | Nahon | 30/34 |
| 3,381,374 | 5/1968 | Prouty | 30/40.1 |

*Primary Examiner*—Jimmy C. Peters

*Attorney, Agent, or Firm*—Hubbard, Thurman, Turner & Tucker

[57] ABSTRACT

Shaving apparatus including reciprocating, rotary and endless belt blades having at least one cutting edge. The belt blade is trained around three spaced apart rollers having their longitudinal axes parallel. The blade and rollers are enclosed in a housing with the length of the blade between two of the rollers creating a flat surface cutting edge to effect the cutting operation. One of the rollers is driven thereby causing the endless belt blade to rotate continuously in a direction parallel to the cutting edge thereof. A cover fits over the cutting blade extending between two of the rollers and is provided with an opening through which the cutting edge of the blade protrudes. A protective comblike shield covers the opening in the head. A second embodiment of the cutting blade is a circular disk with its circumference sharpened to form a cutting edge. The circumference of the circular blade may be serrated to permit a larger cutting surface about the circumference and facilitate engagement of the hair by the blade. In a third embodiment, a shaving apparatus comprises a blade having at least one cutting edge and mechanism for causing the blade to reciprocate along its longitudinal axis thereby introducing a slicing motion to the cutting edge.

3 Claims, 11 Drawing Figures

IMPROVEMENT IN BLADE SYSTEMS FOR SHAVING APPARATUS

BACKGROUND OF THE INVENTION

1. Field of the Invention

This invention relates generally to an apparatus for shaving, and more particularly, to an electric shaver with a shaving blade which moves parallel to the cutting edge thereon.

2. Prior Art

Numerous electric shaving instruments now in use employ the common feature of moving a cutting blade or bar through the hair or fur to be shaved. The action of the blade against the hair in conventional shaving apparatus may best be described as a chopping or shearing action between relatively moving blade edges and the direction of blade motion is basically perpendicular to the cutting edge.

A very limited recognition of the concept of moving a shaving blade parallel to its cutting edge, while drawing the blade along a path transverse to the cutting edge, is found in U.S. Pat. No. 1,552,455 issued to S. Shaler. While the Shaler reference employs longitudinal reciprocation of the cutting edge of a shaving blade, the system fails to provide a convenient and simplistic method of reciprocating the blade. Thus, there has developed an need for a system which provides a superior method of shaving hair or fur by moving a cutting blade parallel to its cutting edge, and thus transversely to the normal path of the blade through the area from which hair is being removed, in order to slice the hair and thereby provide a smoother cut.

SUMMARY OF THE INVENTION

The present invention provides a system which overcomes many of the disadvantages found in the prior art and specifically provides a system for shaving hair by a slicing action instead of by a chopping or shearing action. The present invention provides a system for shaving by moving a blade parallel to its cutting edge to slice the hair as the blade is moved across the face or legs and along a path transverse to the cutting edge. This method is compared to that presently experienced in the use of a safety razor wherein the blade is pulled through the hair without any side to side or slicing motion to effect the cut. The action cutting provided by the present invention greatly reduces the drag experienced by presently used shavers resulting from the "pulling" of the hair during cutting. Thus, the present system gives a shave which is smoother and less irritating to the skin.

In accordance with one embodiment of the present invention, a shaving apparatus comprises an endless belt blade having at least one cutting edge. The blade is entrained about three cylindrical drums or rollers having their longitudinal axes parallel to each other. The blade and rollers are enclosed in a housing with the length of the blade between two of the rollers creating a flat surface cutting edge to effect the cutting operation. One of the cylindrical rollers is motor driven thereby causing the endless blade to rotate continuously in a direction parallel to its cutting edge.

The blade is formed with transverse ribs on the inside wall which correspond with mating indentions in the outer surface of the motor driven roller to provide positive traction between the blade and the roller. A cover is adapted to fit over the cutting blade extending between two of the rollers and is adapted with an opening through which the cutting edge of the blade protrudes. A protective comblike edge prevents the blade from contacting the surface of the skin while permitting the hair to contact the blade and be severed by the action of the blade against the hair.

In accordance with a second embodiment of the invention, the cutting blade is a circular disk with its circumference sharpened to form a cutting edge. The blade is rotated in a housing, and a head is adapted for mounting on the housing with an opening through which the cutting edge of the blade protrudes. A protective shield covers the opening in the head to prevent the cutting edge of the blade from contacting the skin while permitting hair to pass through the protective shield to be sliced by the blade. The circumference of the circular blade may be serrated to permit a layer cutting surface about the circumference and facilitate engagement of the hair by the blade.

In accordance with another aspect of this embodiment of the invention, a series of cutting blades is interposed in a common plane to permit the shaving of a larger area at one time.

In accordance with third and fourth embodiments of the invention, a shaving apparatus is provided which comprises a blade having at least one cutting edge and means forming a groove therein extending generally perpendicular to the cutting edge. A rotatable motor output shaft having its longitudinal axis perpendicular to the plane of the blade, and rotatable about its longitudinal axis, is adapted with an eccentric pin which extends within the groove. A housing is adapted to receive the longitudinal shaft and eccentric pin, and a head portion supports the cutting blade and is adapted to interact therewith. By rotating the shaft, the movement of the eccentric pin within the groove of the blade causes the blade to reciprocate along its longitudinal axis thereby introducing a slicing motion to the cutting edge as it is moved along a path transverse to the cutting edge.

In accordance with another aspect of the third embodiment of the invention, a head covering, having an opening through which the cutting edge of the blade protrudes, is attached to the housing. A protective mesh covers the opening in the head to prevent the cutting edge of the blade from directly contacting the skin. A lubricating stripping is attached within the head covering and contacts the upper surface of the blade when the covering is positioned on the housing. The lubricating stripping restrains the blade and adaptor in their seated position within the housing during reciprocation of the blade with the lubrication eliminating binding or friction between the blade and covering.

In accordance with yet another aspect of this embodiment of the invention, a roller bearing is substituted for the lubricating stripping. The bearing is attached within the head covering and contacts one surface of the blade when the head covering is positioned on the housing. The roller bearing retains the blade and adaptor in their seated positions within the housing during the reciprocation of the blade while permitting the movement of the blade parallel to its cutting edge.

In accordance with still another aspect of the third embodiment of the invention, the cutting blade is attached to an adaptor plate having a protruding leg extending perpendicularly therefrom at each end of the adaptor. The legs extend the width of the adaptor plate and fit within slots provided in the housing. The slots are of equal length with the legs but wider than the width thereof, thereby restricting the adaptor plate to movement along its longitudinal axis, and thus directing the movement of the cutting edge along a single axis.

The present invention still further provides an embodiment which is characterized by a reciprocatory blade member mounted on a head member of a shaving apparatus and supported by a blade support member engaged with an eccentric shaft member of a rotary motor contained within the main housing of the apparatus. A hinged cover portion of the head member includes a comb structure formed along one edge to protect the cutting edge and to position individual hairs or whiskers for being subjected to the slicing motion of the cutting blade. The head member includes a receptacle for receiving cut hairs and has a pivotally mounted door member which is easily opened to empty and clean the receptacle.

While the present invention in primarily directed to shaving hair, as from the face or legs, it will readily be apparent that the system may also be adapted for successful use in shaving fur from animals as well as for peeling thin skins from foods such as potatoes, apples and the like. Additionally, the present apparatus will find use in certain scraping operations such as in removing old paint from a surface being prepared for repainting. While the detailed description of the present invention is directed to its primary use in shaving hair, it will be understood that it is readily adaptable to these and other related shaving and peeling operations.

Thus, the present invention provides a system for shaving hair by moving a blade parallel to its cutting edge to slice the hair as the blade is moved across the face or legs along a path substantially transverse to the cutting edge. The method of cutting employed by the present invention greatly reduces the drag experienced by presently used shaving apparatus resulting from the "pulling" of hair during cutting. Thus, the apparatus of the present invention gives a shave which is smoother, faster and less irritating to the skin.

BRIEF DESCRIPTION OF THE DRAWINGS

For a more complete understanding of the present invention, and for further advantages thereof, reference is now made to the following description taken in conjunction with the accompanying drawings in which.

DESCRIPTION OF THE PREFERRED EMBODIMENTS

Figure 1:
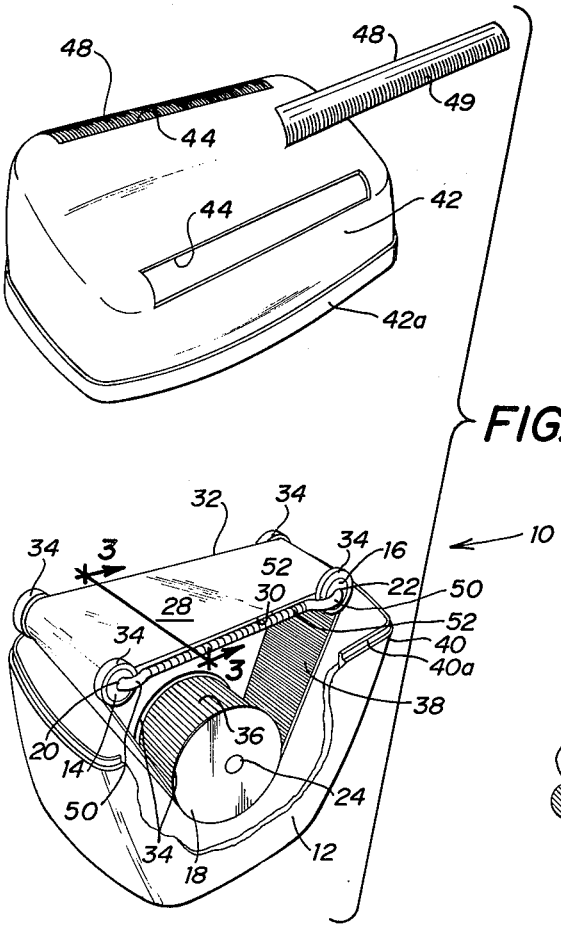
FIG. 1 is an exploded perspective view of one preferred embodiment of the present invention.

FIG. 1 illustrates, in perspective view, a first preferred embodiment of the shaving apparatus of the present invention. The shaving apparatus 10 is composed of a rigid outer lower housing 12 adapted to receive and support three triangularly spaced cylindrical rollers 14, 16 and 18. Roller 14, 16 and 18 are adapted for rotation about their respective axes 20, 22 and 24 which are parallel one to the other. Entrained around each of the rollers is a flexible endless belt blade 28 which is sharpened on at least one of its two edges 30 and 32. Each of the rollers is adapted with flanges 34 on each end thereof in order to retain the belt blade 28 thereon. Further, the rotational axis 24 of roller 18 is coextensive with the axis of an electric motor (not shown) which may be selectively energized to rotate roller 18. The outer circumference of roller 18 is adapted with indentions 36. The inner surface of belt blade 28 is similarly adapted with mating transverse ribs 38 for providing positive traction between roller 18 and belt blade 28. That flat surface of belt blade 28 formed between rollers 14 and 16 extends slightly above the upper edge 40 of housing 12.

A head or cover 42 is adapted for engagement with top edge 40 of housing 12 to enclose the portion of belt blade 28 suspended between rollers 14 and 16. The top edge 40 of housing 12 is provided with an inner lip **40*a* which mates on its outside with a lip 42*a* on the corresponding edge of cover 42. The fit between cover 42 and housing 12 of shaving unit 10 is a simple press fit which permits the cover 42 to be readily removed from the lower housing 12 to clean and service the shaving apparatus. The cover 42 is provided with opposed elongated opening 44 through which the cutting edges 30 and 32 of blade 28 protrude. Protective shields 48 are removably attached over openings 44 in cover 42 and prevent the cutting edges 30 and 32** from contacting the surface of the skin during shaving.

Supports 50 extend from axes 20 and 22 of rollers 14 and 16, respectively. Connected between supports 50 are roller guides 52 and 54, see FIG. 3 also, which are adapted with numerous serrations along their longitudinal length for guiding hair to the cutting edges of blade 28 to assist in the cutting action. Shields 48 are either of the comb type, having a series of fingers 49 spaced to permit only the hair to be exposed to the cutting edge, or of the screen type having perforations therein of sufficient size to permit only the entry of the hair to be severed by the moving cutting edges of blade 28.

In operation, roller 18 is rotated by the electric motor engaged to its rotational axis and its rotation is transmitted to blade 28 thereby causing the entrained blade to rotate around the course defined by rollers 14, 16 and 18. The movement of blade 28 about this course naturally effects a movement of the cutting edges 30 and 32 parallel to the direction of rotation of blade 28. With cover 42 properly engaged on housing 12, as when lip **42*a* is securely interlocked within lip 40*a*, cutting edges 30 and 32 are moving within the openings 44 but behind the protective shields 48 covering the openings. In use, the movement of the shaver 10** is normally along a path transverse to the direction of rotation of cutting edges 30 and 32. Thus, as hair passes through protective shields 48 and is guided against cutting edges 30 and 32 by roller guides 52 and 54, cutting is effected by slicing the hair, as opposed to the chopping or shearing action heretofore employed by conventional shaving apparatus.

Figure 2:
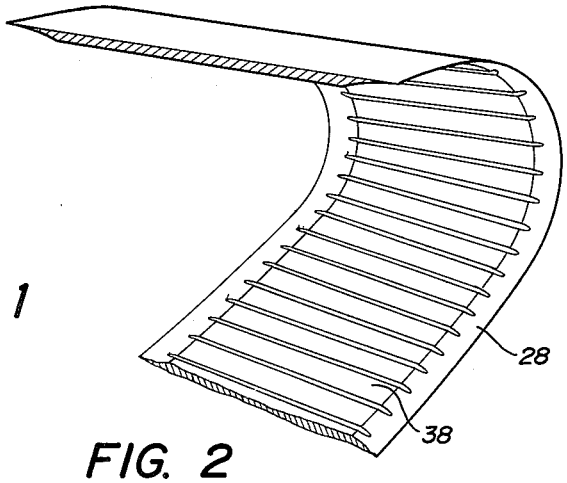
FIG. 2 illustrates in perspective view a section of the endless belt blade used in the embodiment illustrated in FIG. 1.
Figure 3:
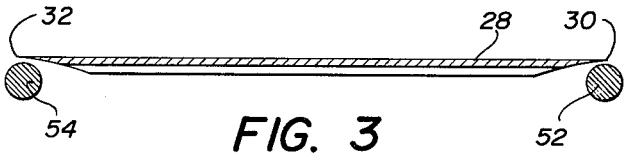
FIG. 3 is a sectional view taken along lines 3—3 of FIG. 1 looking in the direction of the arrows.

Referring to FIG. 2, it is seen that blade 28 is adapted on its inside surface with the trasverse ribs 38 which extend intermediate of the edge 30 and 32 thereof. FIG. 3 shows blade 28 in sectional view and illustrates the relation between roller guides 52 and 54 and cutting edges 30 and 32. As illustrated, the outer edge of the cutting edges is positioned closely to the circumference of roller guides 52 and 54 in order to slice the hair fed to the cutting edged by the roller guides. Furthermore, the action of deflecting the cutting edges 30 and 32 against the roller guides 52 and 54 serves to sharpen and polish the blade during operation. The blade 28 may be formed of stainless steel or other suitable material for forming a knife edge. The thickness of the blade between the ribs 38 is such that the blade is not unlike a flexible belt.

Figure 4:
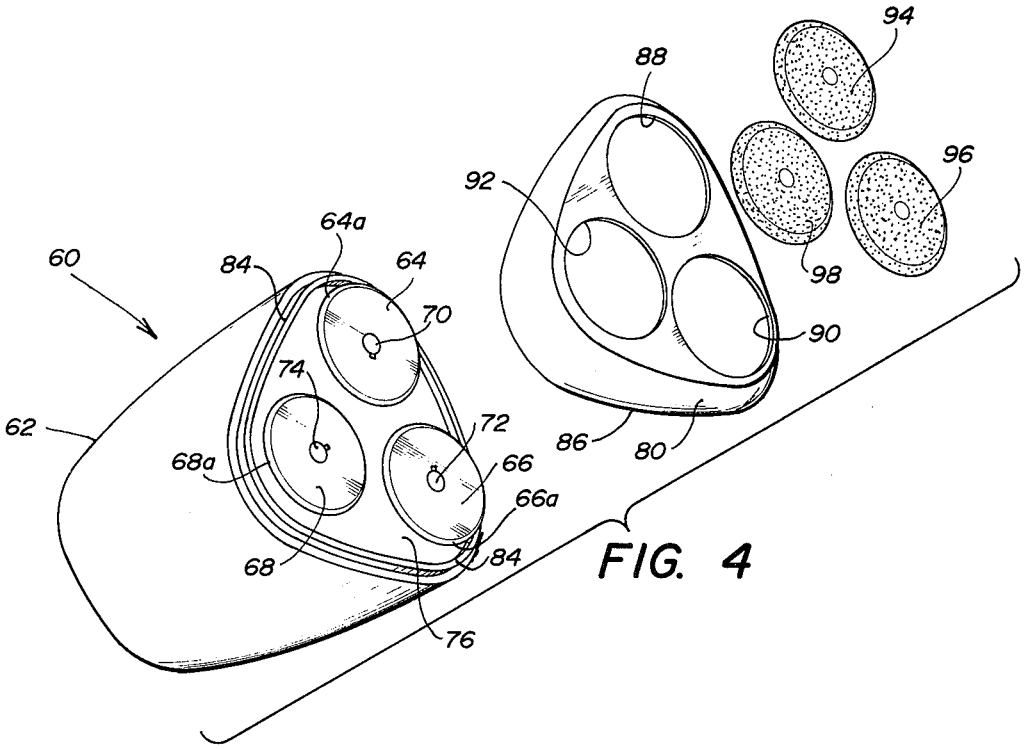
FIG. 4 is an exploded perspective view of a second preferred embodiment of the present invention.

FIG. 4 illustrates in exploded perspective view a second preferred embodiment of the shaving apparatus of the present invention. The shaving apparatus 60 is composed of a rigid outer lower housing 62 adapted to receive three circular disk blades 64, 66 and 68 rotatable about their respective axes 70, 72 and 74. The disk blades are coplanar with each axis parallel to the other. The axes 70, 72 and 74 are defined by shaft portions, not shown, which are suitably drivenly connected to an electric motor, not shown, housed below surface 76 and within housing 62.

Adapted for sealing engagement onto housing 62 and over disk blades 64, 66 and 68 is a cover 80. The upper edge 82 of housing 62 is adapted with a lip 84 which interfits with a corresponding lip 86 on head covering 80 to provide a snap-fit between the head cover and the lower housing 62. Head cover 80 has three apertures, 88, 90 and 92, which correspond to disk blades 64, 66 and 68 when the cover is positioned on housing 62. The cutting edges 64*a*, 66*a* and 68*a* of the disk blades are exposed through the apertures 88, 90 and 92, respectively.

Removably inserted over apertures 88, 90 and 92 are shields 94, 96 and 98, respectively. The protective shields covering the opening prevent the cutting edges of the disk blades from contacting the surface of the skin during shaving. The shields preferably are of the mesh type having perforations therein of sufficient size to permit only hair to pass therethrough and exposed to the cutting edges of the disk blades.

In this embodiment of the invention also the movement of the cutting edges of the disk blades is transverse to the normal blade path as the head of the shaving unit is moved across the part of the body to be shaved. As a result, the cutting effect is best described as a slicing action rather than the conventional chopping movement presently being used in shaving apparatus.

Figure 5:
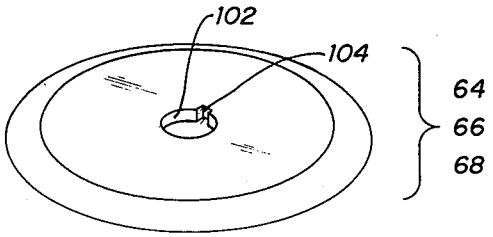
FIG. 5 is a perspective view of the circular disk blade used in the embodiment illustrated in FIG. 4.
Figure 6:
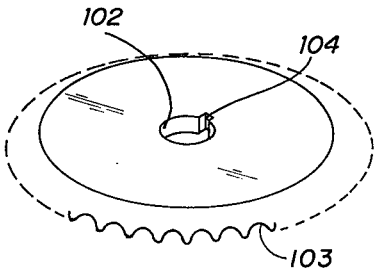
FIG. 6 is an alternative disk blade used in the embodiment illustrated in FIG. 4.

FIGS. 5 and 6 illustrate, in perspective view, two types of disk blades used in the second embodiment of the invention illustrated in FIG. 4. FIG. 5 is a circular disk having a sharpened edge along the complete circumference thereof. FIG. 6 illustrates an alternate form of circular disk blade 101. This blade is provided with scallops 103 around the circumference thereof in order to expose more of the sharpened edge for cutting hair. Both types of blades are adapted with apertures 102 and keyways 104 for mating with cooperating rotatable shafts extending from housing 62.

Figure 7:
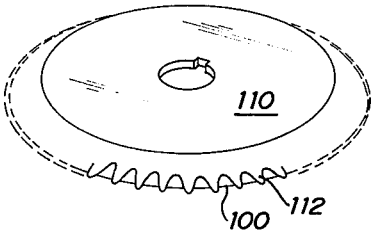
FIG. 7 is a perspective view showing the overlay plate in its relationship to the circular blade when in the assembled configuration.

In the alternative embodiment shown in FIG. 7 an overlay plate 110 has fingers 112 extending beyond the outer circumference of circular disk 100. In this configuration, plate 110 remains stationary while disk 100 is rotated therebelow. The fingers 112 act to restrain the movement of hair brought into contact with the cutting edge of disk 100 in order to facilitate cutting.

In operation, hair that is exposed through protective shields 94, 96 and 98 are guided and restrained from moving by fingers 112 of plate 110. Cutting is effected by the slicing of hair by the cutting edges of disk blades 64, 66 and 68. Hair that is retained within cover 80 may be readily cleaned from the unit by removing the cover from the lower housing 62 and removing the clippings therefrom.

Figure 8:
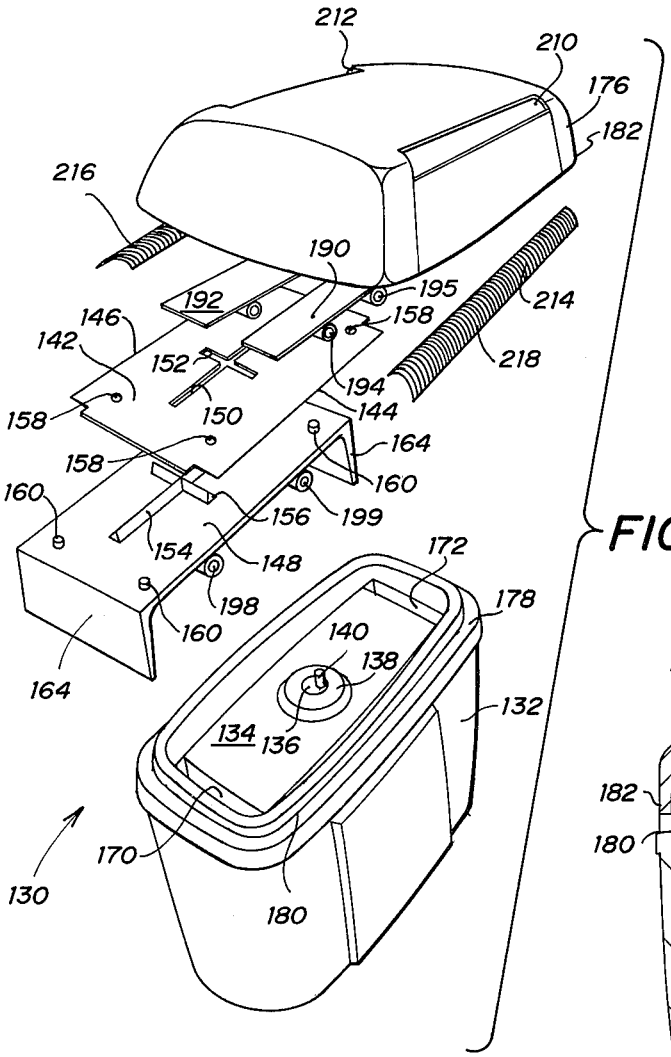
FIG. 8 is an exploded perspective view of a third preferred embodiment of the present invention.

FIG. 8 illustrates, in exploded perspective view, a third preferred embodiment of the shaving apparatus of the present invention. The shaving apparatus 130 includes a rigid outer lower housing 132 adapted with a motor 134 rigidly secured within the housing. An output shaft 136 extends from motor 134 and rotates ring 138 attached thereto. An axially projecting eccentric pin 140 is fixedly attached to ring 138 for rotation therewith.

A blade 142, having cutting edges 144 and 146, is adapted to be received by an adaptor plate 148. Blade 142 is provided with longitudinal and transverse apertures 150 and 152, respectively. Adaptor plate 148 is provided with wedge type projections 154 and 156 for mating with the apertures 150 and 152 in blade 142 to retain the blade on the adaptor. Similarly, blade 142 is provided with holes 158 for mating with nipples 160 projecting upwardly from adaptor plate 148. Nipples 160 interlock within holes 158 to maintain a fixed relationship between blade 142 and adapted plate 148.

Adaptor plate 148 is provided with legs 164 projecting perpendicularly from each end of adaptor plate 148 and extending the width of adaptor 148. The wedge type projection 156, extending transversely of the longitudinal axis of adaptor plate 148, also provides a groove in the underside of adaptor plate 148 which mates with eccentric pin 140 when adaptor plate 148 and blade 152 are positioned thereon. Legs 164 extend between lower housing 132 and motor 134 as adaptor plate 148 and blade 142 are positioned in place. The openings 170 and 172 defined between the lower housing 132 and motor 134 are equal in width to that of legs 164 but substantially wider than the thickness of the legs. Therefore, openings 170 and 172 permit movement of legs 164, and thus adaptor plate 148 and blade 142, along a path parallel to the longitudinal axis of adaptor plate 148 and blade 142.

Figure 9:
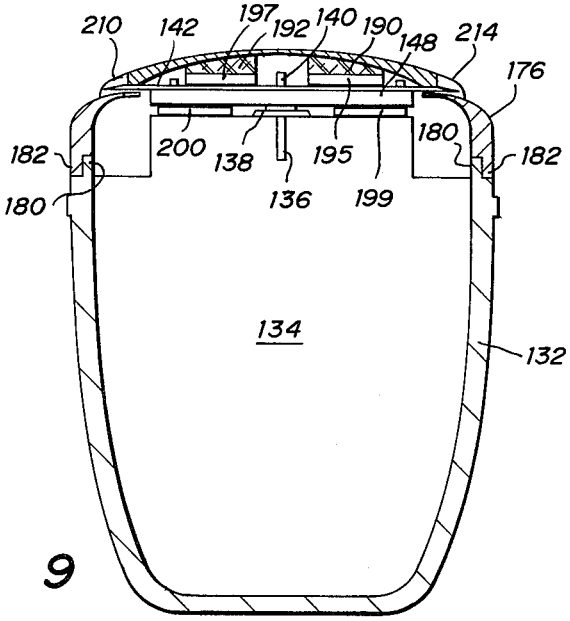
FIG. 9 is a central vertical sectional view of the embodiment shown in FIG. 8 as it would appear in the assembled configuration.

Referring to FIGS. 8 and 9, a cover 176 is provided for interlocking with lower housing 132 over adaptor plate 148 and blade 142. The upper edge 178 of lower housing 132 is provided with a lip 180 which interconnects with a mating lip 182 along the corresponding edge of cover 176. The lips 180 and 182 provide an interlocking snap-fit sufficient to retain head covering 176 on lower housing 132 during operation of the shaving unit. Sandwiched between the underside of head covering 176 and the top surface of blade 142 are lubricating strippings 190 and 192 and four spaced apart roller bearings 194–197, three shown in FIG. 8. In its locked position on lower housing 132, the cover 176 sandwiches lubricating stripping 190 and 192 and roller bearings 194–197 between the inner top surface and blade 142. In this way, blade 142 and adaptor plate 148 are retained in contact with four spaced apart roller bearings 198–201 positioned on the top surface of motor 134, two shown in FIG. 8.

The cover 176 is adapted with apertures 210 and 212 in the top thereof which expose cutting edges 144 and 146 of blade 142. Shields 214 and 216 are removably attached over openings 210 and 212 to prevent the cutting edges of blade 142 from contacting the surface of the user's skin during shaving. Shields 214 and 216 may be of a comb like design, as illustrated, and having a plurality of fingers 218 defining openings therebetween sufficient to permit only hair to be shaved to be exposed therethrough.

In operation, blade 142 is positioned onto adaptor plate 148 and retained in position by projections 154 and 156 and nipples 160 extending from adaptor plate 148 into the apertures 150 and 152 and holes 158 in blade 142. The combined adaptor plate and blade assembly is then positioned such that eccentric pin 140 is located within the groove defined in the underside of adaptor plate 148 by projection 156 and extending transversely of the longitudinal axis of adaptor plate 148. As the adaptor plate and blade assembly are positioned such that pin 140 engages the transverse groove therein, legs 164 are inserted within openings 170 and 172 defined by lower housing 132 and motor 134. The adaptor and blade assembly rests on bearings 198–201 positioned on the top side of motor 134. Head covering 176 is then positioned over the adaptor plate and blade assemblies sandwiching lubricating strippings 190 and 192 and bearings 194–197 therebetween.

With the energization of motor 134, the ring 138 and its eccentric pin 140 are rotated causing eccentric pin 140 to slide within the groove defined by projection 156 thereby causing reciprocation of the adaptor and blade assembly along the longitudinal axis thereof.

The openings 170 and 172 permit oscillation of adaptor plate 148 and blade 142 only along the adaptor plate and the blade's longitudinal axis. The reciprocation of adaptor plate 148 and blade 142 is facilitated by bearings 198–201 and lubricating strippings 190 and 192 in conjunction with bearings 194–197.

With the reciprocation of blade 142 parallel to its cutting edges 144 and 146, the unit is ideally suited for various shaving operations. The shields 214 and 216 guide hair within apertures 210 and 212 where it is exposed to the slicing action of cutting edges 144 and 146. The shaving apparatus 130 will be generally drawn along a path transverse to the cutting edges of the blade and therefore transverse to the direction of reciprocation of the cutting edges. This reciprocation defines a cutting operation wherein the hair engaged by the blade is sliced rather than chopped as in conventional shaving units. The method of reciprocating the adaptor plate and blade through the use of an eccentric pin 140 rotated by motor 134 and in conjunction with shaft 136 and ring 138, is the essence of simplicity without requiring complicated mechanisms to translate the rotary motion of an electric motor to the reciprocation of the blade in the present embodiment.

Figure 10:
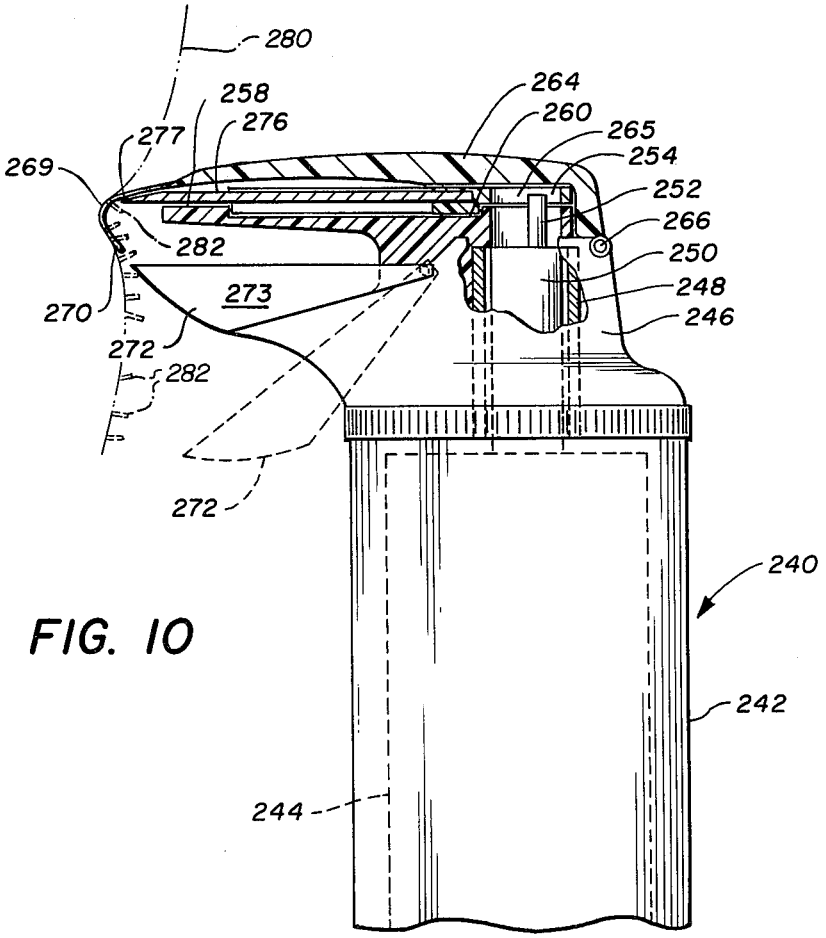
FIG. 10 is a side elevation, partially sectioned, of a fourth embodiment of the present invention.
Figure 11:
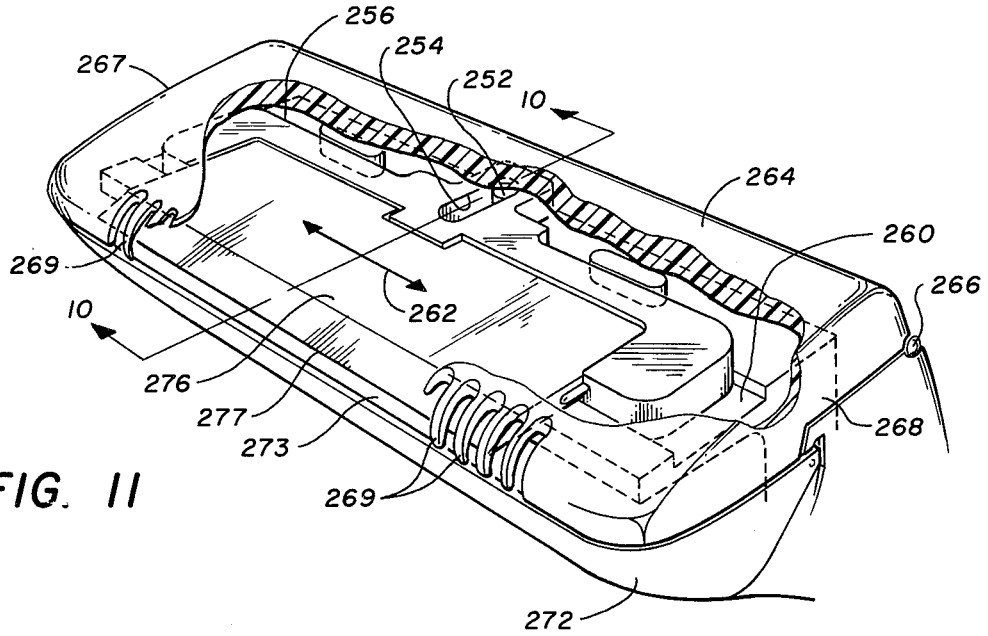
FIG. 11 is a perspective view of the embodiment illustrated in FIG. 10.

Referring now to FIGS. 10 and 11 a fourth embodiment of the present invention is illustrated and is characterized as a shaving apparatus generally designated by the numeral 240. The shaving apparatus 240 includes a housing 242 in which is disposed a suitable electric motor 244. The housing 242 includes a head member 246 which is suitably connected to the housing 244 and includes means forming a bearing 248 journalling a rotary output shaft member of the motor, generally designated by the numeral 250. The shaft 250 includes an axially projecting eccentric drive pin 252 which projects into an elongated slot 254 formed in a blade holding member 256. The head member 246 includes a portion forming a planar support surface 258 having an elongated channel 260 formed therein. The support surface 258 and channel 260 are adapted to support the blade holder 256 for reciprocatory movement in response to rotation of the motor shaft 250 and the eccentric pin 252 within the slot 254. Reciprocation is along a path indicated generally by the double headed directional arrow 262 in FIG. 11. The head member 246 also includes a cover member, generally designated by numeral 264, which is hingedly connected to the head member by suitable hinge means 266. The cover member 264 comprises a generally hollow shell member having opposed sidewalls 267 and 268, FIG. 11, which may be provided with suitable detent means, not shown, cooperable with the head member 246 to retain the cover member in the closed position shown in FIGS. 10 and 11. The cover member 264 also includes, along one longitudinal side thereof, a relatively thin section forming a series of spaced apart parallel openings defined between comb teeth 269. The comb teeth 269 project forwardly and are curved downwardly to terminate in a distal end 270 adjacent to a hinged door member 272 suitably hinged to the housing member 246 along opposed sides thereof. The door 272 is adapted, in its closed position, to form a receptacle 273 for collecting shavings to be cut by the apparatus 240. The comb teeth 269 may be formed integral with the cover member 264 or on a separate insert piece made of thin but substantially rigid stainless steel, for example. The door 272 may be swung downward to the position indicated by the dashed lines in FIG. 10 to permit emptying of the receptacle 273 of hair cutting collected therein.

The shaving apparatus 240 includes a reciprocatory blade member 276 having a longitudinal cutting edge 277 disposed adjacent to the openings formed by the comb teeth 269. The blade 276 may be suitably secured to the holder member 256 and furnished as a throw away type unit once the cutting edge 277 has been dulled and requires blade replacement or sharpening. Alternatively, the blade 276 may be removably insertable in the holder member 256. The blade 276 and the holder 256 are retained in the support channel 260 by the close fitting relationship of the inside surface 265 formed on the cover member 264 as illustrated in FIG. 10.

The operation of the shaving apparatus 240 is similar to the embodiment described in conjunction with FIGS. 8 and 9 in that, in response to operation of the motor 244, the shaft 250 orbits the eccentric pin 252 to effect reciprocation of the blade holder 256 thanks to the cooperation of the pin with the longitudinal slot 254. Accordingly, the blade 276 undergoes a reciprocatory slicing action which, when whiskers are presented to the blade through the openings form between the comb teeth 269, effects a smooth cutting action without the tendency to pull or jerk the whiskers as occurs with shearing action type blades.

FIG. 10 illustrates the preferred orientation of the shaving apparatus 240 when presented to skin surface 280 for cutting short hairs or whiskers 282. As the apparatus 240 is moved relative to the skin surface 280, downward, for example, viewing FIG. 10, the whiskers 282 are presented to the cutting edge 277 in a somewhat normal relationship thereto, which relationship may be accentuated by a pressing action of the outer contoured surface of the comb teeth 269 against the skin surface so that the whiskers will be properly oriented as they pass between the comb teeth.

Of course, the cover member 264 may be easily flipped open about the axis formed by the hinge 266 to provide for rapid inspection and replacement of the blade 276 as needed. Moreover, the door 272 may also be flipped downwardly, viewing FIG. 10, at will, to allow cuttings retained in the receptacle 273 to be removed from the apparatus.

Thus, the present invention provides a system for shaving hair by moving the cutting blade parallel to its cutting edge to slice the hair as the blade is moved across the face or legs along a path transverse to the cutting edge. This method of cutting is compared to that presently experienced in the use of a safety razor or electric shaver wherein the blade is pulled through the hair without any side to side or slicing motion to effect the cut. The method of cutting employed by the present invention greatly reduces the drag experienced by presently used shavers resulting from the "pulling" of the hair during cutting. Therefore, the present system gives a shave which is smoother, and faster and less irritating to the skin. Further, while the present invention will have its largest application in shaving hair, as from the face or legs, it may likewise be successfully used for shaving fur from animals as well as for peeling thin from certain fruits and vegetables.

Whereas the present invention has been described with respect to specific embodiments thereof, it will be understood that various changes and modifications will be suggested to one skilled in the art, and it is intended to encompass such changes and modifications as fall within the scope of the appended claims.

What I claim is:

1. A shaving apparatus, comprising:

a blade having at least one elongated cutting edge and being secured to a blade support member having a groove extending perpendicular to said cutting edge;

a housing having a motor disposed therein and drivably connected to said blade for effecting reciprocation of said blade substantially parallel to its cutting edge to effect a slicing type of shaving action;

a head member disposed on said housing and having a channel formed therein for receiving and supporting said blade support member for reciprocation in said channel;

a rotary shaft of said motor including an eccentric pin disposed in said groove and drivably connected to said blade support member for reciprocating said blade support member and said blade;

a cover supported on said head member for preventing direct engagement of said blade with a surface to be shaved, said cover including a plurality of spaced apart comb teeth formed along one edge of said cover and extending across said cutting edge of said blade and providing spaces between adjacent ones of said teeth for guiding hairs to be presented to said blade for being cut by a slicing action.

2. The shaving apparatus set forth in claim 1 wherein:

said teeth each terminate at a distal end and include a curved portion adjacent said distal end, respectively, for engagement with the surface to be shaved to assist in orienting hair to be cut into a cutting position.

3. The shaving apparatus set forth in claim 1 including:

a door on said head member and forming with said head member a receptacle for receiving cuttings from said blade.

* * * * *